US005303519A

United States Patent [19]

Mustee et al.

[11] Patent Number: 5,303,519

[45] Date of Patent: Apr. 19, 1994

[54] SHOWER STALL WITH MOLDED ANGLE PANEL

[75] Inventors: Robert J. Mustee, Middleburg Heights; William E. Trsek, North Olmsted, both of Ohio

[73] Assignee: E. L. Mustee & Sons, Inc., Cleveland, Ohio

[21] Appl. No.: 760,372

[22] Filed: Sep. 16, 1991

[51] Int. Cl.[5] ..... E04B 1/00; A47K 3/16

[52] U.S. Cl. ..... 52/35; 52/34; 52/716.1; 52/717.01; 52/592.1

[58] Field of Search ..... 52/34, 35 OR, 716.1, 52/717.01, 718.01, 264, 265, 595

[56] References Cited

U.S. PATENT DOCUMENTS

| | | | |
|---|---|---|---|
| 3,007,213 | 2/1955 | Hobbs | 52/35 |
| 4,384,377 | 5/1983 | Calvert et al. | 52/34 |
| 4,993,201 | 2/1991 | Bunyard | 52/35 |

*Primary Examiner*—Carl D. Friedman

*Assistant Examiner*—Wynn E. Wood

*Attorney, Agent, or Firm*—Watts, Hoffmann, Fisher & Heinke

[57] ABSTRACT

A molded angle panel and method is disclosed. The preferred angle panel has two improved grooves for receiving tongues when being mounted to adjacent sidewalls when assembling a shower stall. These grooves allow the angle panel to be compression molded. The grooves are comprised of a groove surface located substantially adjacent the angle panel's face which is positioned such that its plane intersects the plane of a bearing surface. The planes of the groove surfaces are substantially parallel. The parallelism of the groove surfaces allows the mold halves to be separated upon the completion of the molding process. The third surface is an intermediate surface and is between the groove surface and the bearing surface. An alternative embodiment of the invention has two improved tongues for allowing the molding of the angle panel.

15 Claims, 4 Drawing Sheets

SHOWER STALL WITH MOLDED ANGLE PANEL

TECHNICAL FIELD

This invention relates to a compression molded, fiberglass reinforced, corner angle panel for use with other fiberglass impregnated components to construct a fiberglass shower stall and more particularly to a tongue and groove mounting system which allows the angle panel to be molded.

BACKGROUND

A typical shower stall is generally constructed with three fiberglass walls, a glass door and a shower base. The fiberglass walls are compression molded and are attached together with a tongue and groove mounting system. The molding process puts limitations on the shapes of the walls which can be molded.

Prior tongue and groove mounting systems for shower walls do not allow for a cornerpiece or an angle panel to be compression molded. Compression molding involves two mold halves which are placed together under pressure to mold the desired piece. When the piece is finished, the mold halves must be pulled apart. The shape of the desired piece must allow the mold halves to separate. Prior tongues and grooves prevented the molding of cornerpieces or angle panels because the halves could not be separated after the panel was molded.

In compression molding, use of a mold of more than two pieces is not satisfactory due, at least in part, to the pressure applied during the molding process. A mold of more than two pieces could not be held in place satisfactorily under the pressure and tends to come apart. More over, molds of more than two piece construction at their best are complicated and expensive. The inability satisfactorily to mold corner panels has put severe limitations on the shape and style of shower stalls that could be completely molded.

SUMMARY OF THE INVENTION

A molded cornerpiece or angle panel embodying the present invention has a uniquely shaped tongue-receiving groove or a uniquely shaped tongue for its mounting structure which allows it to be compression molded. The angle panel is mounted with sidewalls having typically shaped tongues or grooves.

With the preferred embodiment, the angle panel has grooves at the end portions of each angle panel side for receiving a tongue from an adjacent sidewall or panel. The groove has three surfaces. A groove surface and a bearing surface have an intermediate surface located between them. The groove surface is located substantially adjacent the angle panel's face and is positioned such that its plane intersects the plane of the bearing surface. The planes of both groove surfaces are substantially parallel.

A two-piece mold is utilized to mold the angle panel. The first mold half is shaped to the configuration of the angle panel's back. The second half is shaped to the configuration of the panel's face and end portions. Because the two groove surfaces are substantially parallel, the mold halves can be easily separated at the completion of the molding process since the top half of the mold can be pulled off smoothly and easily along a path paralleling the groove surface planes. The angle panel can then be removed from the bottom half in the same direction.

DETAILED DESCRIPTION OF THE PREFERRED EMBODIMENT

Figure 1:
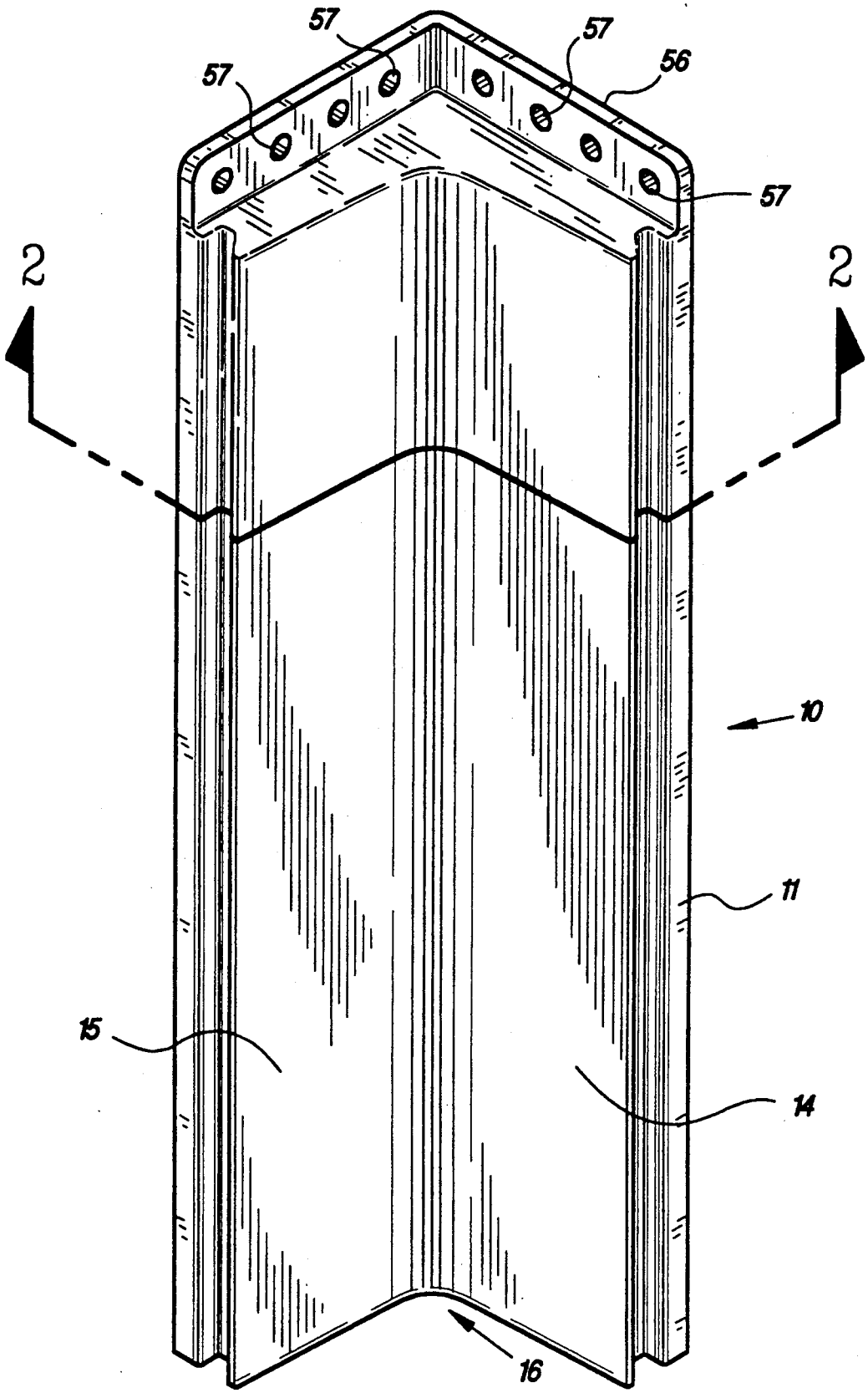
FIG. 1 is a perspective view of the molded angle panel of this invention.
Figure 2:
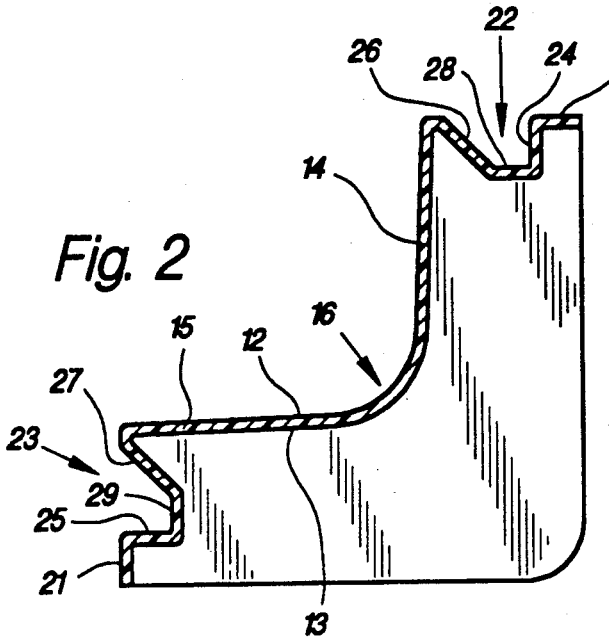
FIG. 2 is a cross sectional view of the molded angle panel of this invention as seen from the plane indicated by the line 2—2 of FIG. 1.
Figure 3:
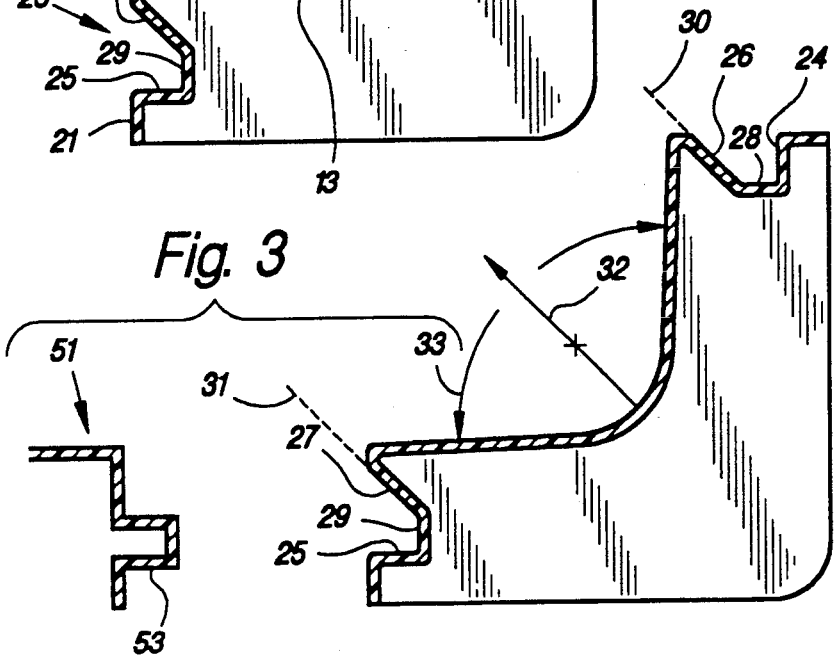
FIG. 3 is a cross sectional view of the molded angle panel of this invention illustrating an interior angle the angle panel defines and a ray which bisects the interior angle.

A molded angle panel 10 having an elongate body 11 is shown generally in FIG. 1. The angle panel includes two panel walls 14, 15 joined at a corner location 16. As illustrated in FIGS. 2 and 3, the angle panel 10 has a panel face 12 and a panel back 13.

In the embodiment of FIGS. 1–3, 5, 6, the angle panel 10 further includes side edge portions having sidewall mounting structure in the form of lips 20, 21 and sidewall receiving grooves 22, 23. Each of the grooves 22, 23 is defined by three surfaces. Bearing surfaces 24, 25 are respectively located substantially adjacent the lips 20, 21. Ramp surfaces 26, 27 are located substantially adjacent the panel face 12. Intermediate surfaces 28, 29 are respectively located between the bearing surfaces 24, 25 and the ramp surfaces 26, 27.

As indicated in FIG. 3, imaginary planes 30, 31 are located by the ramp surfaces 26, 27. An imaginary ray 32 has its endpoint at the panel face 12, proceeds away from the angle panel 10 and bisects an interior angle 33 defined by the two panel walls 14, 15 at the corner location 16. The planes 30, 31 parallel the ray 32 and proceed in the direction of the ray 32. Thus, the ramp surfaces 26, 27 are substantially parallel and are not divergent with respect to the planes 30, 31. This allows the mold halves to be pulled apart upon completion of the molding process. As long as the surfaces 26, 27 are substantially parallel or convergent in a direction away from the face 12, the mold halves can be separated. Ideally, the ramp surfaces 26, 27 should converge 2–4 degrees in the direction of ray 32 with respect to the planes 30, 31 to provide the easiest mold half separation.

FIG. 3 further illustrates a typically shaped sidewall mounting tongue 53 for use in mounting a sidewall 51 with the angle panel 10 of the embodiment illustrated in FIGS. 1–3, 5, 6.

Figure 4:
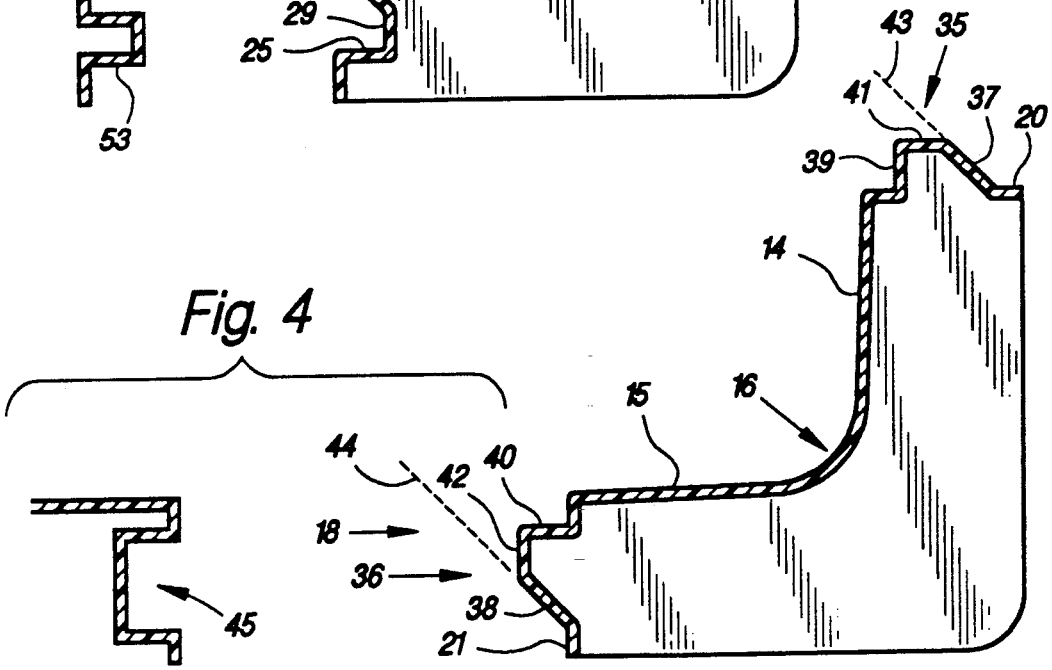
FIG. 4 is a cross sectional view of the molded angle panel illustrating an alternative embodiment of this invention.

FIG. 4 illustrates an alternative embodiment of an angle panel 10 wherein each panel wall side edge portion utilizes mounting structure which has a component in the form of a sidewall engaging tongue 35, 36 as opposed to a sidewall receiving groove. The tongues 35, 36 are the reverse profile of the grooves 22, 23. Each of the tongues 35, 36 are defined by three surfaces. Ramp surfaces 37, 38 are located substantially adjacent the lips 20, 21. Bearing surfaces 39, 40 are located substantially adjacent the panel face 12. Intermediate surfaces 41, 42 are respectively located between the portion surfaces 37, 38 and the bearing surfaces 39, 40. Imaginary planes 43, 44 containing the ramp surfaces 37, 38 proceed with the same relationship as the imaginary planes 30, 31 containing the ramp surfaces 26, 27 illustrated in FIG. 2, thereby allowing the mold halves to be pulled apart upon completion of the molding process. Groove 45 illustrates a typically shaped sidewall mounting groove for receiving a tongue 35, 36 shaped according to this embodiment.

Figure 5:
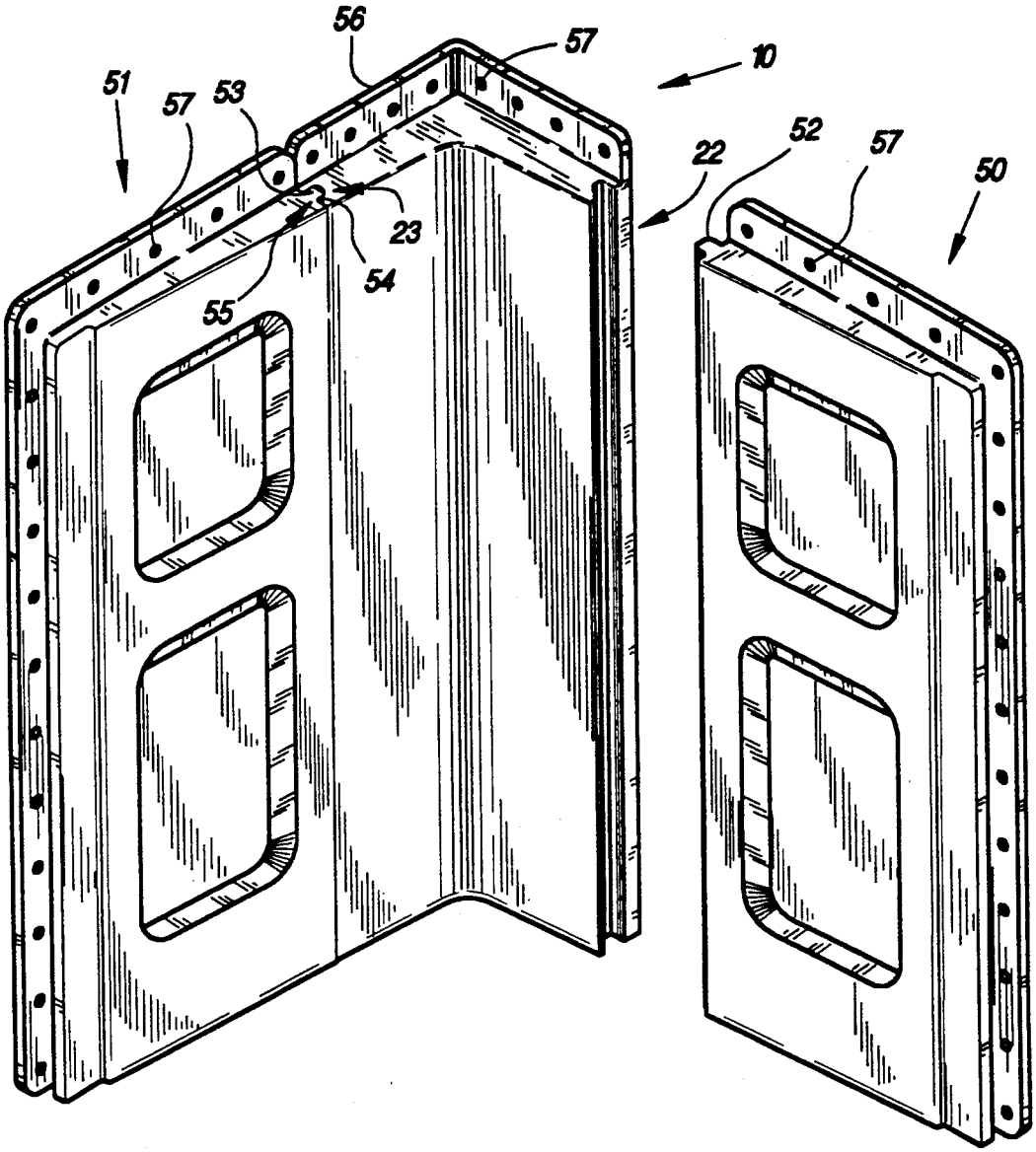
FIG. 5 is a perspective, partially exploded view of the molded angle panel of this invention with other molded panels; and, FIG. 6 is a perspective, partially exploded view of the molded angle panel of this invention with other molded panels and a shower base.

FIG. 5 illustrates an angle panel 10 associated with two sidewalls 50, 51. A corresponding sidewall tongue 52, 53 is placed in each of the grooves 22, 23, respectively thereby forming an interconnection between the sidewalls 50, 51 and the angle panel 10. A sealant 54 is placed between each groove surface 26, 27 and a corresponding portion of the sidewall tongue 52, 53. A recess 55 defined by the ramp surfaces 26, 27 and the adjacent (corresponding) portions of the sidewall tongues 52, 53 allow for improved sealing. The recess 55 allows for ample sealant 54, preferably a clear silicon sealant, as opposed to a thin layer of sealant or merely an adhesive as allowed for with a typical prior tongue and groove mounting system. The sidewalls 50, 51 and the angle panel 10 are mounted on and around a shower base 58.

A flange 56, having a plurality of indentations 57 (illustrated in FIG. 1) for starting fasteners such as drywall screws or nails, is used to mount the angle panel 10 to a wall or support stud.

The angle panel 10 is molded utilizing two mold halves, the first of which is shaped similar to the angle panel back. The second half is shaped similar to the angle panel face. The area between the mold halves when placed together defines a cavity for shaping the angle panel. Each mold half is heated independently. A sheet molding compound of fiber reinforced composite, preferably fiberglass, is used to mold the panel. The sheet molding compound has a viscosity range of 10–20 million centipoise as measured by a Brookfield HBT Viscometer. A pre-measured sheet molding compound charge is cut and placed between the mold halves. The mold halves are then brought together and pressure is applied with a hydraulic column press to squeeze the sheet molding compound and fill out the mold cavity. The pressure is maintained until the sheet molding compound cures, generally 90–100 seconds. Once the sheet molding compound is cured, the press will decompress and the mold halves are separated. The top half is removed in the direction of the ray 32 in FIG. 3. The angle panel 10 is removed from the bottom half in the same direction of the ray 32. The angle panel 10 is then deflashed.

Figure 6:
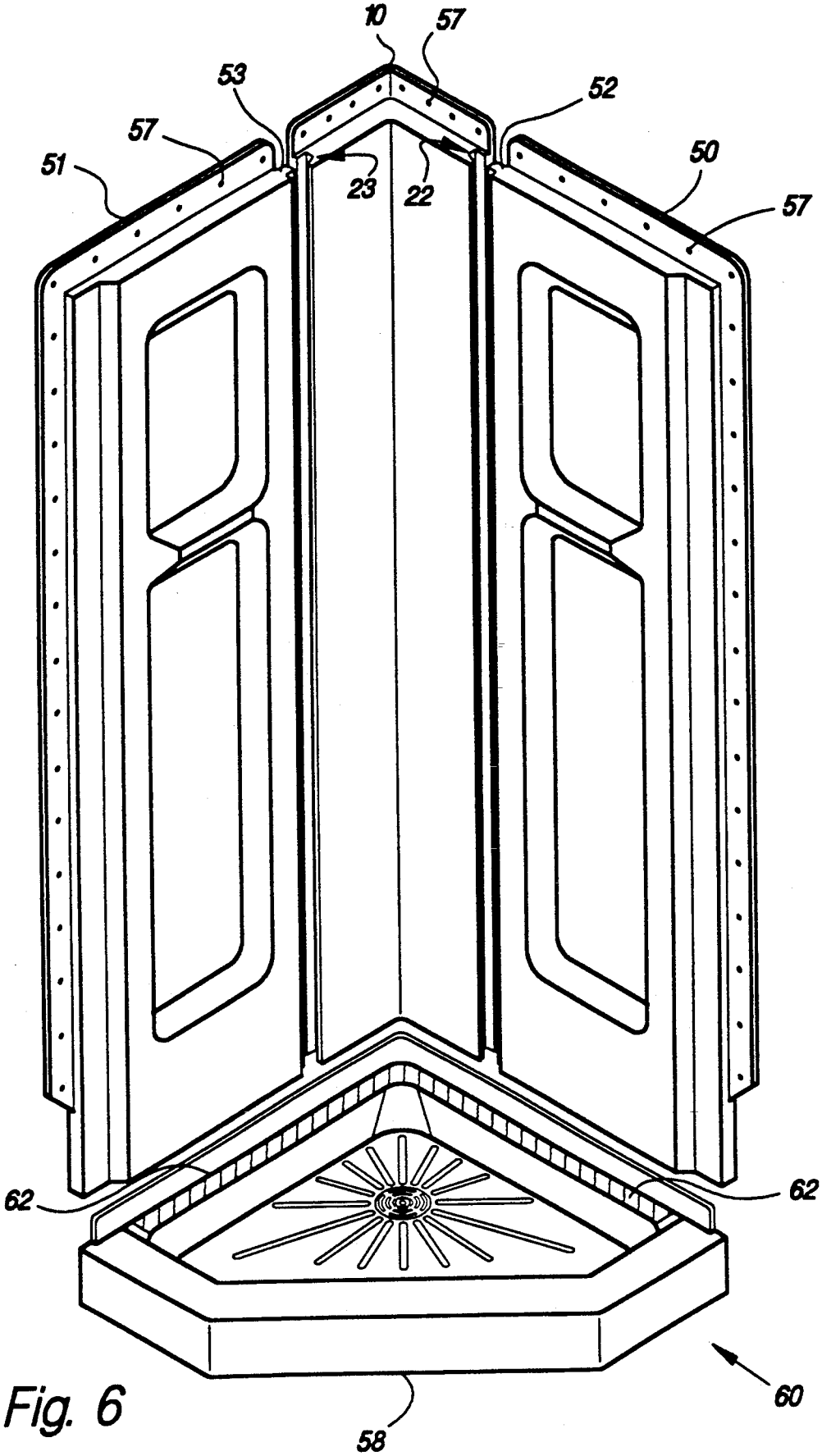

A shower stall 60 is illustrated in FIG. 6. In order to assemble a shower stall 60, the shower base 58 is located at a desired shower stall location. The angle panel 10 is installed first with a sealant 62 being placed between the base 58 and the angle panel 10. The angle panel is secured to a support stud, preferably with drywall screws (not shown). The sealant 54 is placed in the first of the grooves 22. A sealant 62 is placed between the base 58 and the sidewall 50. The sidewall 50 is then mounted to the angle panel 10 and the base 58 with the tongue 52 being placed in the groove 22. The sidewall is then secured to a support stud, preferably with drywall screws (not shown). The process is repeated for the second sidewall 51 and its corresponding groove 23.

While a preferred embodiment of the invention has been illustrated and described in detail, the present invention is not to be considered limited to the precise construction disclosed. Various adaptations, modifications and uses of the invention may occur to those skilled in the art to which the invention relates and the intention is to cover hereby all such adaptations, modifications and uses which fall within the spirit or scope of the appended claims.

We claim:

1. A molded angle panel for securing two adjacent sidewalls in place with respect to each other to form a corner, said angle panel defining an interior angle and comprising:

a. a panel face and a panel back;

b. first and second panel walls joined at a corner location, each panel wall having an edge portion extending away from said corner location;

c. sidewall mounting structure located at said edge portion of said first panel wall, said mounting structure comprising a first sidewall receiving groove having:

i. a first planar bearing surface forming one side of said groove; and, ii. a first planar ramp surface whose plane intersects the plane of said first bearing surface, said ramp surface being located substantially adjacent said panel face; and, d. second sidewall mounting structure at the extending edge portion of said second panel wall, said mounting structure comprising a second sidewall receiving groove having:

i. a second planar bearing surface forming one side of said groove; and, ii. a second planar ramp surface whose plane intersects the plane of said second bearing surface, said ramp surface being located substantially adjacent said panel face;

wherein the planes of said first and second ramp surfaces extend in respective directions which do not diverge proceeding in the direction of a ray which bisects said interior angle such that the grooves and the panel face may be delineated by one section of a two-section mold.

2. The angle panel of claim 1 wherein both sidewall receiving grooves have an intermediate surface located between their respective bearing surface and ramp surface.

3. The angle panel of claim 1 wherein the planes containing said first and second ramp surfaces are substantially parallel to each other.

4. The angle panel of claim 1 wherein the planes containing said first and second ramp surfaces are convergent proceeding in the direction of a ray which bisects said interior angle.

5. The angle panel of claim 1 wherein a sidewall is mounted on each sidewall mounting structure and a sealing means is placed between each of said first and second ramp surfaces and a corresponding sidewall mounting portion.

6. A molded angle panel for securing two adjacent sidewalls in place with respect to each other to form a corner, said angle panel defining an interior angle and comprising:

a. a panel face and a panel back;

b. first and second panel walls joined at a corner location, each panel wall having an edge portion extending away from said corner location;

c. first sidewall mounting structure at said edge portion of said first panel wall, said mounting structure comprising a first lip and a first tongue projecting from said first panel wall edge portion and having:
i. a first planar bearing surface forming one side of said tongue; and,
ii. a first planar ramp surface whose plane intersects the plane of said first bearing surface, said ramp surface being substantially adjacent said first lip; and, d. second sidewall mounting structure at said edge portion of said second panel wall, said mounting structure comprising a second lip and a second tongue projecting from said second panel wall edge portion and having:
i. a second planar bearing surface forming one side of said tongue; and,
ii. a second planar ramp surface whose plane intersects the plane of said second bearing surface, said second planar ramp surface being substantially adjacent said second lip;

wherein said first and second ramp surface planes extend in respective directions which do not diverge proceeding in the direction of a ray which bisects said interior angle such that the tongues and the panel face may be delineated by one section of a two-section mold.

7. The angle panel of claim 6 wherein both sidewall engaging tongues have an intermediate surface located between their respective bearing surface and ramp surface.

8. The angle panel of claim 6 wherein the planes containing said first and second ramp surfaces are substantially parallel to each other.

9. The angle panel of claim 6 wherein the planes containing said first and second ramp surfaces are convergent proceeding in the direction of a ray which bisects said interior angle.

10. The angle panel of claim 6 wherein a sidewall is mounted on each sidewall mounting structure and a sealing means is placed between each of said first and second ramp surfaces and a corresponding sidewall mounting portion.

11. A shower stall comprising at least one molded angle panel utilizing a tongue and groove mounting system to secure two adjacent molded sidewalls in place with respect to each other and a shower base, said angle panel defining an interior angle and comprising:

a. a panel face and a panel back;

b. first and second panel walls joined at a corner location, each panel having an edge portion extending away from said corner location;

c. first sidewall mounting structure at said edge portion of said first panel wall, said mounting structure comprising a first sidewall receiving groove having:
i. a first planar bearing surface forming one side of said groove;
ii. a first planar ramp surface whose plane intersects the plane of said first bearing surface, said ramp surface being substantially adjacent said panel face; and,
iii. a first intermediate surface located between said first bearing surface and said first ramp surface; and, d. second sidewall mounting structure at said edge portion of said second panel wall, said second sidewall mounting structure comprising a second sidewall receiving groove having:
i. a second planar bearing surface forming one side of said groove;
ii. a second planar ramp surface whose plane intersects the plane of said second bearing surface, said second planar ramp surface being substantially adjacent said panel face; and,
iii. a second intermediate surface located between said second bearing surface and said second ramp surface;

each said adjacent sidewall having a tongue corresponding with its respective said first and second grooves to form said tongue and groove mounting system;

said tongue and groove mounting system including a sealing means located between said tongue of each of said sidewalls and its respective said first and second grooves;

wherein the planes of said first and second ramp surfaces extending in respective directions which are substantially parallel.

12. A molded angle panel of fiber reinforced composite material, said panel comprising:

a) an elongate body having a face and a back each having portions at angles with one another in a plane of transverse cross section;

b) the body having a pair of spaced edge portions each configured for interconnection with an adjacent panel when in use;

c) each edge portion including a selected component of a tongue and groove interconnection;

d) each component including a planar ramp surface, a bearing surface, and an intermediate surface connecting the ramp surface and the bearing surface; and, e) wherein the planes of the ramp surfaces extend in directions which do not diverge in the direction towards the face from the back such that the components and the face may be delineated by one section of a two-section mold.

13. The angle panel of claim 12 wherein said ramp surfaces are substantially parallel.

14. The angle panel of claim 12 wherein each component is a tongue.

15. The angle panel of claim 12 wherein each component is a groove.

* * * * *